US011873455B2

(12) United States Patent
Peinado et al.

(10) Patent No.: US 11,873,455 B2
(45) Date of Patent: Jan. 16, 2024

(54) PROCESS HAVING IMPROVED BASE OIL YIELD

(71) Applicant: Chevron U.S.A. Inc., San Ramon, CA (US)

(72) Inventors: Kenny Peinado, Discovery Bay, CA (US); Jifei Jia, Hercules, CA (US); Guan-Dao Lei, San Ramon, CA (US); Jay Parekh, San Ramon, CA (US); Yihua Zhang, Albany, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 17/138,038

(22) Filed: Dec. 30, 2020

(65) Prior Publication Data

US 2022/0204876 A1 Jun. 30, 2022

(51) Int. Cl.
*C10G 45/62* (2006.01)
*C10G 67/04* (2006.01)

(52) U.S. Cl.
CPC ..... *C10G 67/0418* (2013.01); *C10G 45/62* (2013.01); *C10G 2300/1022* (2013.01); *C10G 2300/304* (2013.01); *C10G 2300/70* (2013.01); *C10G 2400/10* (2013.01)

(58) Field of Classification Search
CPC ..... C10G 45/62; C10G 65/043
See application file for complete search history.

(56) References Cited

U.S. PATENT DOCUMENTS 3,632,835 A * 1/1972 Mitsche ..... C07C 5/226 585/374
6,383,366 B1 * 5/2002 Riley ..... C10G 45/64 585/734
6,555,725 B1 * 4/2003 Wittenbrink ..... B01J 19/2485 585/734
6,569,312 B1 5/2003 Carroll et al.
8,192,612 B2 6/2012 Rosenbaum et al.
8,475,648 B2 7/2013 Krishna et al.
8,790,507 B2 7/2014 Krishna et al.
8,852,207 B2 10/2014 Simpson et al.
2004/0079678 A1 * 4/2004 Germaine ..... C10G 65/043 208/107
2004/0099571 A1 * 5/2004 Germaine ..... C10G 2/32 208/108
2004/0181109 A1 9/2004 Miller
2008/0032886 A1 * 2/2008 Yeh ..... C10G 50/00 502/118
2010/0176026 A1 7/2010 Cole et al.
2018/0187087 A1 * 7/2018 Atkins ..... C10G 45/60
2018/0215683 A1 * 8/2018 Koseoglu ..... C07C 5/2791

FOREIGN PATENT DOCUMENTS

EP 1444180 A2 8/2004

OTHER PUBLICATIONS

International Search Report and Written Opinion issued in PCT/IB2021/062289 dated Mar. 24, 2022.

* cited by examiner

*Primary Examiner* — Randy Boyer
(74) *Attorney, Agent, or Firm* — E. Joseph Gess; Melissa M. Hayworth; Mark L. Warzel

(57) ABSTRACT

Provided is a process for preparing base oil from a waxy hydrocarbon feedstock by contacting the hydrocarbon feedstock in a hydroisomerization zone under hydroisomerization conditions. The reaction is in the presence of hydrogen and an inert gas, with the total pressure in the hydroisomerization zone being at least 400 psig. A product from the hydroisomerization zone is collected and separated into base oil products and fuel products. The inert gas can comprise any suitable inert gas, but is generally nitrogen, methane or argon. Nitrogen is used in one embodiment.

29 Claims, 1 Drawing Sheet

PROCESS HAVING IMPROVED BASE OIL YIELD

TECHNICAL FILED

Process for improving the yield of high quality base oils from a waxy hydrocarbon feedstock.

BACKGROUND

High quality lubricating oils are critical for the operation of modern machinery and motor vehicles. Finished lubricants used for automobiles, diesel engines, axles, transmissions, and industrial applications consist of two general components, a base oil and one or more additives. Base oil is the major constituent in these finished lubricants and contributes significantly to the properties of the finished lubricant. In general, a few base oils are used to manufacture a wide variety of finished lubricants by varying the mixtures of individual base oils and individual additives. Most crude oil fractions require moderate to significant upgrading to be suitable for lubricant manufacture. As an example, high-quality lubricating oils must often be produced from waxy feeds. Numerous processes have been proposed for producing lubricating base oils by upgrading ordinary and low quality feedstocks.

Hydrocarbon feedstocks may be catalytically dewaxed by hydrocracking or hydroisomerization. Hydrocracking generally leads to a loss in yield due to the production of lower molecular weight hydrocarbons, such as middle distillates and even lighter $C_{4-}$ products, whereas hydroisomerization generally provides higher yields by minimizing cracking.

U.S. Pat. No. 8,475,648 describes processes and a catalyst for dewaxing a heavy hydrocarbon feedstock to form a lubricant base oil. A layered catalyst system is used. See also U.S. Pat. No. 8,790,507. U.S. Pat. No. 8,192,612 describes processes for preparing a base oil slate from a waxy feed. The disclosures of the foregoing patents are incorporated herein by reference in their entirety.

Improving the yield of the base oil product would be of great interest to the industry. Providing a process which can improve yield simply while maintaining a smooth operation would have to be of paramount interest.

SUMMARY

In one embodiment, provided is a process for preparing base oil from a waxy hydrocarbon feedstock by contacting the hydrocarbon feedstock in a hydroisomerization zone under hydroisomerization conditions. The reaction is conducted in the presence of hydrogen and an inert gas, with the total pressure in the hydroisomerization zone being at least 400 psig. A product from the hydroisomerization zone is collected and separated into base oil products and fuel products. The inert gas can comprise any suitable inert gas, but is generally nitrogen, methane, argon, or a combination thereof. Nitrogen is used in one embodiment.

The combination of the inert gas with hydrogen can maintain the gas pressure at a sufficiently high pressure to satisfy the requirements of a refinery high pressure hydroprocessing operation. The combination has also been found to result in an increased final base oil yield.

DETAILED DESCRIPTION

Figure 1:
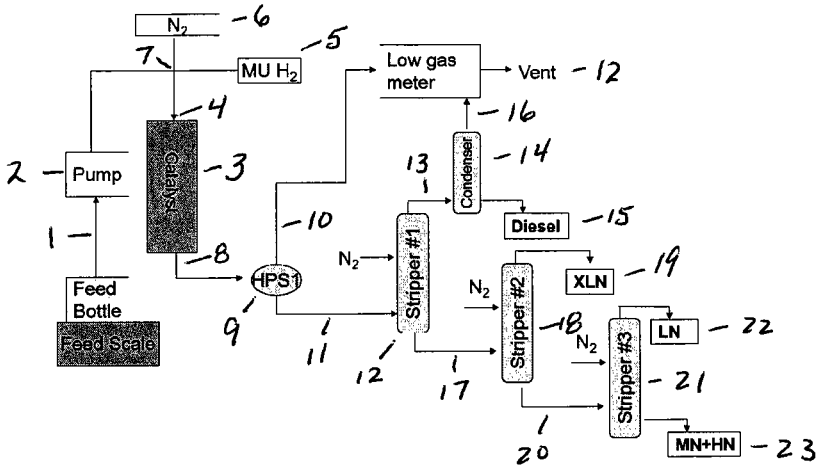
FIG. 1 schematically depicts a Bench Scale Unit (BSU) process to make base oils by diluting $H_2$ with $N_2$ gas for the hydroisomerization dewaxing step.

The present process begins by subjecting a waxy hydrocarbon feed to a hydroisomerization dewaxing process. Hydrogen is used in the hydroisomerization dewaxing process. In the present process, however, the hydrogen is diluted with an inert gas. The inert gas can by any suitable inert gas, such as $N_2$, $CH_4$, argon, or a combination thereof. However, nitrogen is preferred. By using a mix of hydrogen and an inert gas in the reactor, the high gas pressure conditions necessary to operate a refinery high pressure hydroprocessing operation is maintained. Moreover, by using the mix of hydrogen and an inert gas, it has been surprisingly found that an increased base oil yield is realized.

The term "waxy feed" as used in this disclosure refers to a feed having a high content of normal paraffins (n-paraffins). A waxy feed useful in the practice of the present process scheme will generally comprise at least 40 wt. % n-paraffins, preferably greater than 50 wt. % n-paraffins, and more preferably greater than 75 wt. % n-paraffins. Preferably, the waxy feed used in the present process scheme will also have very low levels of nitrogen and sulfur, generally less than 25 ppm total combined nitrogen and sulfur and preferably less than 20 ppm. This can be achieved by hydrotreating before dewaxing.

A wide variety of hydrocarbon feedstocks can be used, including whole crude petroleum, reduced crudes, vacuum tower residua, synthetic crudes, foots oils, Fischer-Tropsch derived waxes, and the like. Typical feedstocks can include hydrotreated or hydrocracked gas oils, hydrotreated lube oil raffinates, brightstocks, lubricating oil stocks, synthetic oils, foots oils, Fischer-Tropsch synthesis oils, high pour point polyolefins, normal alphaolefin waxes, slack waxes, deoiled waxes and microcrystalline waxes. Other hydrocarbon feedstocks suitable for use in processes of the present process scheme may be selected, for example, from gas oils and vacuum gas oils; residuum fractions from an atmospheric pressure distillation process; solvent-deasphalted petroleum residua; shale oils, cycle oils; animal and vegetable derived fats, oils and waxes; petroleum and slack wax; and waxes produced in chemical plant processes.

In an embodiment, the hydrocarbon feedstocks can be described as waxy feeds having pour points generally above about 0° C., and having a tendency to solidify, precipitate, or otherwise form solid particulates upon cooling to about 0° C. Straight chain n-paraffins, either alone or with only slightly branched chain paraffins, having 16 or more carbon atoms may be referred to herein as waxes. The feedstock will usually be a $C_{10+}$ feedstock generally boiling above about 350° F. (177° C.). In contrast, the base oil products of the present process, resulting from hydroisomerization dewaxing of the feedstock, generally have lowered pour points below 0° C., typically below about −12° C., and often below about −14° C.

The present processes may also be suitable for processing waxy distillate stocks such as middle distillate stocks including gas oils, kerosenes, and jet fuels, lubricating oil stocks, heating oils, and other distillate fractions whose pour point and viscosity need to be maintained within certain specification limits.

Feedstocks for the present processes may typically include olefin and naphthene components, as well as aromatic and heterocyclic compounds, in addition to higher molecular weight n-paraffins and slightly branched paraffins. During the present processes, the degree of cracking of n-paraffins and slightly branched paraffins in the feed is strictly limited so that the product yield loss is minimized, thereby preserving the economic value of the feedstock.

In an embodiment, the feedstock may comprise a heavy feed. Herein, the term "heavy feed" may be used to refer to a hydrocarbon feedstock wherein at least about 80% of the components have a boiling point above about 900° F. (482° C.). Examples of heavy feeds suitable for practicing the present process includes heavy neutral (600 N) and bright stock.

According to one aspect of the present process, a wide range of feeds may be used to produce lubricant base oils in high yield with good performance characteristics, including low pour point, low cloud point, low pour-cloud spread, and high viscosity index. The quality and yield of the lube base oil product of the instant invention may depend on a number of factors, including the formulation of the hydroisomerization catalysts comprising the layered catalyst systems and the configuration of the catalyst layers of the catalyst systems.

According to one embodiment of the present process, a catalytic dewaxing process for the production of base oils from a waxy hydrocarbon feedstock involves introducing the feed into a reactor containing a dewaxing catalyst system. Hydrogen gas is introduced into the reactor so that the process may be performed in the presence of hydrogen. In a high pressure hydroprocessing operation the total pressure must be maintained above a minimum pressure, such as 400-500 psig. A pressure above 500 psig can be maintained in the present process. The total pressure in the hydroisomerization zone can range from 500 psig to 3000 psig, or more likely from 750 psig to 3000 psig.

To maintain the pressure above the minimum required pressure, e.g., 400-500 psig, in a high pressure hydroprocessing operation is very important. In the present process the combination of an inert gas added together with the hydrogen achieves the minimum pressure, e.g., of at least 400 psig. The inert gas can be added together with the hydrogen in a mixture before entering the reactor. This is preferred. The inert gas can also be added to the reactor separately from the hydrogen.

The inert gas used in combination with hydrogen can be any suitable inert gas. Mixtures of these inert gases can also be used. Nitrogen, methane, and argon are examples. Nitrogen is a preferred inert gas to be used in combination with the hydrogen. It is important to maintain sufficient hydrogen for the reaction. Generally, the volume ratio of $H_2$ to inert gas ranges from 0.1 to 9.0; or more likely from about 0.2 to 4.0. In one embodiment, the volume ratio of $H_2$ to inert gas can range from about 0.3 to 2.0. A volume ratio of 1, where equal volumes of hydrogen and inert gas are used is quite acceptable. The volumes of each gas can also be maintained and adjusted as the reaction proceeds.

Within the reactor, the feed may first be contacted with a hydrotreating catalyst under hydrotreating conditions in a hydrotreating zone or guard layer to provide a hydrotreated feedstock. Contacting the feedstock with the hydrotreating catalyst in a guard layer may serve to effectively hydrogenate aromatics in the feedstock, and to remove N- and S-containing compounds from the feed, thereby protecting the hydroisomerization catalysts of the catalyst system. By "effectively hydrogenate aromatics" is meant that the hydrotreating catalyst is able to decrease the aromatic content of the feedstock by at least about 20%. The hydrotreated feedstock may generally comprise $C_{10+}$ n-paraffins and slightly branched isoparaffins, with a wax content of typically at least about 20%.

Hydroisomerization catalysts useful in the present process typically contain a catalytically active hydrogenation metal. The presence of a catalytically active hydrogenation metal leads to product improvement, especially VI and stability. Typical catalytically active hydrogenation metals include chromium, molybdenum, nickel, vanadium, cobalt, tungsten, zinc, platinum, and palladium. The metals platinum and palladium are especially preferred, with platinum most especially preferred. If platinum and/or palladium is used, the total amount of active hydrogenation metal is typically in the range of 0.1 wt. % to 5 wt. % of the total catalyst, usually from 0.1 wt. % to 2 wt. %.

The refractory oxide support may be selected from those oxide supports, which are conventionally used for catalysts, including silica, alumina, silica-alumina, magnesia, titania and combinations thereof.

The conditions under which the present processes are carried out will generally include a temperature within a range from about 390° F. to about 800° F. (199° C. to 427° C.). In an embodiment, the hydroisomerization dewaxing conditions includes a temperature in the range from about 550° F. to about 700° F. (288° C. to 371° C.). In a further embodiment, the temperature may be in the range from about 590° F. to about 675° F. (310° C. to 357° C.). The total pressure may be in the range from about 400 to about 3000 psig (0.10 to 20.68 MPa), and typically in the range from about 750 to about 2500 psig (0.69 to 17.24 MPa).

Typically, the feed rate to the catalyst system/reactor during dewaxing processes of the present process may be in the range from about 0.1 to about 20 h.sup.-1 LHSV, and usually from about 0.1 to about 5 h.sup.-1 LHSV. Generally, the present dewaxing processes are performed in the presence of hydrogen. As discussed, the hydrogen is mixed with an inert gas in the present process. Typically, the hydrogen/inert gas to hydrocarbon ratio may be in a range from about 2000 to about 10,000 standard cubic feet Hz/inert gas per barrel hydrocarbon, and usually from about 2500 to about 5000 standard cubic feet $H_2$/inert gas per barrel hydrocarbon.

In an embodiment, the present process provides base oil production, e.g., from a waxy feed, using a layered catalyst system. The layered catalyst system may comprise first and second hydroisomerization catalysts, wherein the first hydroisomerization is disposed upstream from the second hydroisomerization catalyst. The first hydroisomerization catalyst may have a first level of selectivity for the isomerization of n-paraffins, the second hydroisomerization catalyst may have a second level of selectivity for the isomerization of n-paraffins. In an embodiment, the first and second levels of selectivity may be the same or at least substantially the same. A layered catalyst system, according to the present process, may provide superior results as compared with conventional dewaxing processes and catalysts.

The above reaction conditions may apply to the hydrotreating conditions of an optional hydrotreating zone as well as to the hydroisomerization conditions. The reactor temperature and other process parameters may vary according to factors such as the nature of the hydrocarbon feedstock used and the desired characteristics (e.g., pour point, cloud point, VI) and yield of the base oil product.

The product collected from the dewaxing reaction can be passed to various strippers to isolate various grade of base oils. The product can also be sent to a distillation column to separate fuel and various grades of base oils.

Base oils recovered from the distillation column will include a range of base oil grades. Typical base oil grades recovered from the distillation column include, but are not necessarily limited to, XXLN, XLN, LN, MN, and HN. An XXLN grade of base oil when referred to in this disclosure is a base oil having a kinematic viscosity at 100° C. between about 1.5 cSt and about 3.0 cSt, preferably between about 1.8 cSt and about 2.3 cSt. An XLN grade of base oil will have a kinematic viscosity at 100° C. between about 1.8 cSt and about 3.5 cSt, preferably between about 2.3 cSt and about 3.5 cSt. A LN grade of base oil will have a kinematic viscosity at 100° C. between about 3.0 cSt and about 6.0 cSt, preferably between about 3.5 cSt and about 5.5 cSt. An MN grade of base oil will have a kinematic viscosity at 100° C. between about 5.0 cSt and about 15.0 cSt, preferably between about 5.5 cSt and about 10.0 cSt. An HN grade of base oil will have a kinematic viscosity at 100° C. above 10 cSt. Generally, the kinematic viscosity of a HN grade of base oil at 100° C. will be between about 10.0 cSt and about 30.0 cSt, preferably between about 15.0 cSt and about 30.0 cSt. In addition to the various base oil grades, a diesel product may also be recovered from the distillation column.

Diesel fuels prepared/separated out as part of the product slate will generally have a boiling range between about 65° C. (about 150° F.) and about 400° C. (about 750° F.), typically between about 205° C. (about 400° F.) and about 315° C. (about 600° F.).

Alternatively, before separating the fuel product and various grade of base oils, the product from the dewaxing reaction can first be forwarded to a hydrofinishing zone. Such hydrofinishing may be performed in the presence of a hydrogenation catalyst, as is known in the art. The hydrogenation catalyst used for hydrofinishing may comprise, for example, platinum, palladium, or a combination thereof on an alumina support. The hydrofinishing may be performed at a temperature in the range from about 350° F. to about 650° F. (176° C. to 343° C.), and a pressure in the range from about 400 psig to about 4000 psig (2.76 to 27.58 1 MPa). Hydrofinishing for the production of lubricating oils is described, for example, in U.S. Pat. No. 3,852,207, the disclosure of which is incorporated by reference herein.

Further illustration of the present process can be obtained upon a review of the Figures of the Drawing. The descriptions provided are meant to be illustrative and not limiting.

In FIG. 1, a hydrocarbon feed 1 is pumped 2 to enter a hydrodewaxing reactor 3 at 4. Hydrogen 5 for the reaction is mixed with $N_2$ 6 in order to mix with the hydrogen volume passed to the reactor 3. The two gases are mixed at 7 and the mixture enters the reactor at 4. The total pressure of the two gases meets the minimum requirements of the high pressure system, e.g., at least 400 psig.

A dewaxed product 8 is recovered from the bottom of the reactor. Due to the mixture of hydrogen with an inert gas such as $N_2$, it has been found that the yield of base oil product is increased relative to a process using only hydrogen in the hydrodewaxing reactor.

The product 8 is passed to a high pressure separator 9. The high pressure separator generally separates out the gas 10 from the liquid product 11. The gas can be passed to vent 12, whereas the liquid product can be passed for separation into fuel and different grades of base oil products. The separation can be achieved by passing the product 11 to a distillation column (not shown) or to a series of strippers. A distillation column would separate the fuel product from each of the grades of base oils desired.

In FIG. 1, a series of strippers is used to achieve the separation. The liquid product 11 is passed to the first stripper 12. Lighter products are recovered out of the top of the stripper at 13, which are passed to a condenser at 14. Fuel, specifically diesel fuel 15, is recovered out of the bottom of the condenser, and any gas 16 out of the top. The gas 16 is generally passed to vent 12.

Product 17 from the bottom of stripper 12 is passed to the second stripper 18. An XLN grade of base oil 19 is recovered from the top of the stripper, and the heavier product 20 from the bottom of the stripper is passed to another stripper 21. An LN grade of base oil 22 is recovered from the top of the stripper 21, while base oil products of grades MN+HN are recovered from the bottom at 23. The mixture of MN+HN can be passed to further separation, e.g., another stripper, if desired.

Figure 2:
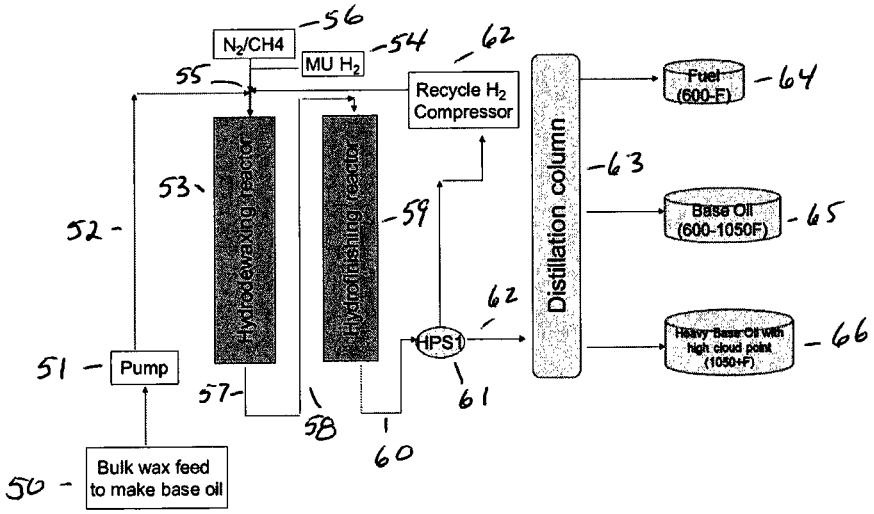
FIG. 2 schematically depicts a process including hydrofinishing base oils. The $H_2$ is diluted with $N_2$ and/or $CH_4$ in the hydrodewaxing step.

In FIG. 2, a commercial base oil production with bulk dewaxing is shown. A bulk waxy hydrocarbon feed 50 is pumped by pump 51 via 52 to a hydrodewaxing reactor 53. Hydrogen 54 for the reaction is mixed at 55 with an inert gas. In FIG. 2, the inert gas 56 is a mixture of nitrogen $N_2$ and methane $CH_4$.

A dewaxed product 57 is recovered from the bottom of the reactor 53. The product 57 in bulk is passed via 58 to a hydrofinishing reactor 59 containing a hydrogenation catalyst. The product 60 from the hydrofinishing reactor 59 is passed to a high pressure separator 61 which can separate out the gases for recycle 62 if desired. The fuel and base oil products are passed via 62 to a distillation column 63. This distillation column separates the fuel product 64 from the base oil products. FIG. 2 shows one base oil product 65 boiling throughout the range of 600-1050° F. (315-565° C.), and a second heavy base oil product 66 with high cloud point and boiling above 1050° F. (565° C.). Additional base oil grades can be separated out using the distillation column as is known in the art.

Overall, the use of a mixture of $H_2$ with an inert gas in the present process provides one with an increased yield of base oil products.

As used in this disclosure the word "comprises" or "comprising" is intended as an open-ended transition meaning the inclusion of the named elements, but not necessarily excluding other unnamed elements. The phrase "consists essentially of" or "consisting essentially of" is intended to mean the exclusion of other elements of any essential significance to the composition. The phrase "consisting of" or "consists of" is intended as a transition meaning the exclusion of all but the recited elements with the exception of only minor traces of impurities.

Numerous variations of the present invention may be possible in light of the teachings and examples herein. It is therefore understood that within the scope of the following claims, the invention may be practiced otherwise than as specifically described or exemplified herein.

All of the publications cited in this disclosure are incorporated by reference herein in their entireties for all purposes.

That which is claimed is:

1. A process for preparing base oil from a waxy hydrocarbon feedstock comprising:

a) contacting the hydrocarbon feedstock in a hydroisomerization zone under hydroisomerization conditions in the presence of hydrogen and an inert gas, with total pressure in the zone where the total pressure ranges from 750 psig to 2500 psig and the volume ratio of hydrogen to inert gas ranging from 0.1 to 9.0; and b) collecting a product from the hydroisomerization in a), and passing the product to a hydrofinishing reactor; and c) collecting a product from the hydrofinishing reactor and separating the product into base oil products and fuel products with the base oil products being recovered, and with the recovered base oil yield being increased relative to using only hydrogen in the hydroisomerization zone.

2. The process of claim 1, wherein the inert gas comprises nitrogen, methane, argon, or a combination thereof.

3. The process of claim 1, wherein the inert gas comprises nitrogen.

4. The process of claim 1, wherein the volume ratio of hydrogen to inert gas ranges from about 0.2 to 4.0.

5. The process of claim 1, wherein the volume ratio of hydrogen to inert gas is about 1.

6. The process of claim 1, wherein the waxy hydrocarbon feedstock is hydrotreated prior to the hydroisomerization in a).

7. The process of claim 1, wherein the hydroisomerization zone employs a hydroisomerization catalyst that contains an active hydrogenation metal.

8. The process of claim 7, wherein the active hydrogenation metal comprises platinum.

9. The process of claim 7, wherein the hydroisomerization catalyst is doped with a metal modifier selected from the group consisting of Mg, Ca, Sr, Ba, K, La, Pr, Nd, Cr, and combination thereof.

10. The process of claim 7, wherein the hydroisomerization catalyst comprises a layered catalyst system, comprising first and second hydroisomerization catalysts where the first hydroisomerization catalyst is in a layer disposed upstream of the second hydroisomerization catalyst.

11. The process of claim 1, wherein the product from the hydroisomerization in a) is passed to a high pressure separator to separate gases.

12. The process of claim 11, wherein at least a portion of the separated gases are recycled to the hydroisomerization zone.

13. The process of claim 1, wherein the separating into base oil products and fuel products is achieved by a series of strippers.

14. The process of claim 1, wherein the separating into base oil products and fuel products is achieved by a distillation column.

15. A process for preparing base oil from a waxy hydrocarbon feedstock comprising:

a) hydrotreating the waxy hydrocarbon feedstock;

b) contacting the hydrotreated waxy hydrocarbon feedstock in a hydroisomerization zone under hydroisomerization conditions in the presence of hydrogen and an inert gas, with total pressure in the zone at least 400 psig and the volume ratio of hydrogen to inert gas ranging from 0.1 to 9.0; and c) collecting a product from the hydroisomerization in b), and passing the product to a hydrofinishing reactor; and d) collecting a product from the hydrofinishing reactor and separating the product into base oil products and fuel products with the base oil products being recovered, and with the recovered base oil yield being increased relative to using only hydrogen in the hydroisomerization zone.

16. The process of claim 15, wherein the inert gas comprises nitrogen, methane, argon, or a combination thereof.

17. The process of claim 15, wherein the inert gas comprises nitrogen.

18. The process of claim 15, wherein the volume ratio of hydrogen to inert gas ranges from about 0.2 to 4.0.

19. The process of claim 15, wherein the volume ratio of hydrogen to inert gas is about 1.

20. The process of claim 15, wherein the total pressure is at least 500 psig.

21. The process of claim 15, wherein the total pressure in the hydroisomerization zone ranges from 400 psig to 3000 psig.

22. The process of claim 15, wherein the hydroisomerization zone employs a hydroisomerization catalyst that contains an active hydrogenation metal.

23. The process of claim 22, wherein the active hydrogenation metal comprises platinum.

24. The process of claim 22, wherein the hydroisomerization catalyst is doped with a metal modifier selected from the group consisting of Mg, Ca, Sr, Ba, K, La, Pr, Nd, Cr, and combination thereof.

25. The process of claim 22, wherein the hydroisomerization catalyst comprises a layered catalyst system, comprising first and second hydroisomerization catalysts where the first hydroisomerization catalyst is in a layer disposed upstream of the second hydroisomerization catalyst.

26. The process of claim 15, wherein the product from the hydroisomerization in b) is passed to a high pressure separator to separate gases.

27. The process of claim 26, wherein at least a portion of the separated gases are recycled to the hydroisomerization zone.

28. The process of claim 15, wherein the separating into base oil products and fuel products is achieved by a series of strippers.

29. The process of claim 15, wherein the separating into base oil products and fuel products is achieved by a distillation column.

* * * * *